US012460912B2

(12) United States Patent
Cousinard

(10) Patent No.: US 12,460,912 B2
(45) Date of Patent: Nov. 4, 2025

(54) BOMB FUZE INITIATOR

(71) Applicant: JUNGHANS T2M SAS, La Ferte Saint-Aubin (FR)

(72) Inventor: Thierry Cousinard, La Ferte Saint-Aubin (FR)

(73) Assignee: JUNGHANS T2M SAS, La Ferte Saint-Aubin (FR)

( * ) Notice: Subject to any disclaimer, the term of this patent is extended or adjusted under 35 U.S.C. 154(b) by 105 days.

(21) Appl. No.: 18/139,888

(22) Filed: Apr. 26, 2023

(65) Prior Publication Data

US 2024/0288256 A1 Aug. 29, 2024

(30) Foreign Application Priority Data

May 5, 2022 (FR) ..... 2204253

(51) Int. Cl.
*F42C 13/00* (2006.01)
*F42C 13/02* (2006.01)

(52) U.S. Cl.
CPC ..... *F42C 13/023* (2013.01)

(58) Field of Classification Search
CPC ..... F42C 13/023; F42C 13/042; F42C 13/045
See application file for complete search history.

(56) References Cited

U.S. PATENT DOCUMENTS 4,031,827 A 6/1977 Collier
4,567,828 A * 2/1986 Campagnuolo ..... F42C 11/04 102/202.2
4,936,187 A * 6/1990 Teeter ..... F42C 15/40 102/221
10,533,831 B1 1/2020 Choiniere et al.

FOREIGN PATENT DOCUMENTS

WO 2019/032178 A2 2/2019

* cited by examiner

*Primary Examiner* — J. Woodrow Eldred
(74) *Attorney, Agent, or Firm* — BakerHostetler

(57) ABSTRACT

A bomb fuze initiator equipped with a cap configured to open after bomb release, a device for detecting bomb release, a device for determining bomb speed, an integrated proximity sensor and a fuze connector intended to connect the fuze initiator to a bomb fuze, the integrated proximity sensor comprising: a transceiver of electromagnetic waves comprising an HF antenna and an HF circuit or comprising an IR source and a photodetector, and a transmission link configured to transmit the signal delivered by the transceiver of electromagnetic waves.

7 Claims, 3 Drawing Sheets

BOMB FUZE INITIATOR

CROSS-REFERENCE TO RELATED APPLICATION

This application claims priority to foreign French patent application No. FR 2204253, filed on May 5, 2022, the disclosure of which is incorporated by reference in its entirety.

FIELD OF THE INVENTION

The invention relates to a bomb fuze initiator and to a bomb equipped with a bomb fuze (or priming device) placed in a base well, and to such a fuze initiator placed in an accessory well.

The invention is applicable to the field of the fuzes of airborne bombs that are intended to be fastened under aeroplane pylons, whether said bombs are equipped with a guidance kit of not. It relates to a device for detecting proximity or proximity sensor, for a bomb fuze.

BACKGROUND

FIG. 1 schematically shows a bomb 1 equipped with a base well 2 comprising a bomb fuze 3, with an accessory well 4, and with a warhead well 5. A connecting channel or tube 6 connects the accessory well 4 to the base well 2, and a connecting channel or tube 7 connects the warhead well 5 to the accessory well 4.

It is known to place a bomb proximity sensor 8 in the warhead well 5 of the bomb 1 and to connect it to the fuze 3, which is housed in the base well 2, via an internal electrical link of the bomb passing through the connecting channels 6 and 7. However, most existing guided armaments use the warhead well 5 for other functions, and especially for a guidance kit, this therefore preventing a proximity sensor from being housed therein.

A proximity sensor uses reflection of radio-frequency waves to determine height with respect to the ground. It generally consists of an antenna, of a radio-frequency transceiver and of a circuit for processing the signal. The proximity sensor must benefit from a clear line of sight.

It is also known, as illustrated in FIG. 2, when the warhead well 5 of the bomb 1 is occupied by an element of the guidance kit, to integrate a proximity sensor 8 into the front portion of the guidance kit, generally comprising a double proximity sensor so as to obtain a rollwise coverage of 360°. As a variant, it is also known to incorporate a proximity sensor 8 elsewhere on the bomb 1, for example in the tail unit, as illustrated in FIG. 3.

Such embodiments have the following drawbacks:

- development of a proximity sensor specific to the configuration of the bomb and to the guidance kit; and
- non-interchangeability of the proximity sensor with other munitions.

SUMMARY OF THE INVENTION

One aim of the invention is to overcome the aforementioned problems, and especially to provide, for a bomb equipped with a proximity-sensing function, a fuze system that is adaptable to any munition armament configuration comprising an accessory well and a base well.

According to one aspect of the invention, a bomb fuze initiator is provided that is equipped with a cap configured to open after bomb release, a device for detecting bomb release, a device for determining bomb speed, an integrated proximity sensor and a fuze connector intended to connect the fuze initiator to a bomb fuze, the integrated proximity sensor comprising:

- a transceiver of electromagnetic waves comprising an HF antenna and an HF circuit or comprising an IR source and a photodetector; and
- a transmission link configured to transmit the signal delivered by the transceiver of electromagnetic waves.

According to one embodiment, the fuze initiator comprises an electronic circuit for processing the signal delivered by the transceiver of electromagnetic waves, said circuit being configured to determine the distance between the bomb and the ground based on said signal, and to transmit said distance to the fuze via the connector.

As a variant, the electronic circuit for processing the signal delivered by the transceiver of electromagnetic waves, said circuit being configured to determine the distance between the bomb and the ground based on said signal, may be integrated into the bomb fuze.

According to one embodiment, the release-detecting device is configured to detect release of the bomb and to guarantee the cap is kept in closed position in the absence of a traction force consistent with release, and configured to inform the bomb fuze of detection of release.

In one embodiment, the device for determining release speed is configured to determine the release speed of the bomb and configured to inform the bomb fuze thereof.

According to another aspect of the invention, a bomb is also provided, the bomb being equipped with a bomb fuze placed in a base well, and with a fuze initiator according to one of the preceding claims, placed in an accessory well, the connector of the fuze initiator being connected to the bomb fuze.

In one embodiment, the bomb fuze is configured to command detonation of the bomb when the distance between the bomb and the ground as determined by the electronic processing circuit is smaller than a detonation command threshold.

For example, the threshold is comprised between 3 m and 16 m.

BRIEF DESCRIPTION OF THE DRAWINGS

The invention will be better understood on studying a few embodiments that are described by way of completely non-limiting examples and illustrated by the appended drawings, in which.

Throughout the figures, elements having identical references are similar.

DETAILED DESCRIPTION

Figure 1:
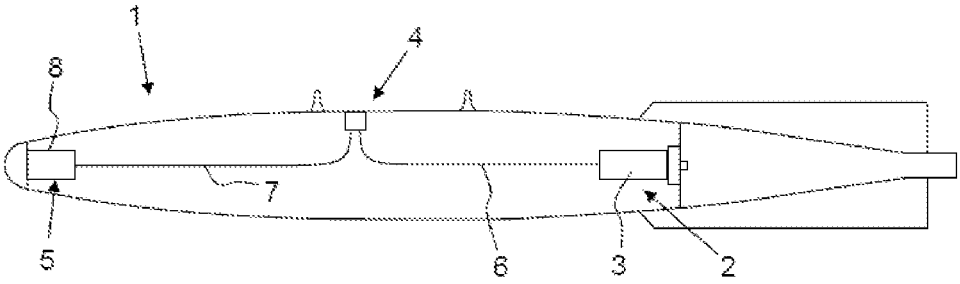
FIG. 1 schematically illustrates a bomb equipped with a proximity sensor, according to the prior art.
Figure 2:
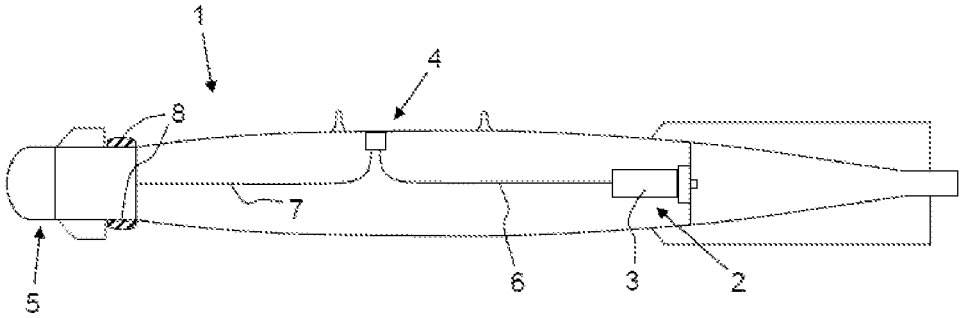
FIG. 2 schematically illustrates a bomb equipped with a proximity sensor, according to the prior art.
Figure 3:
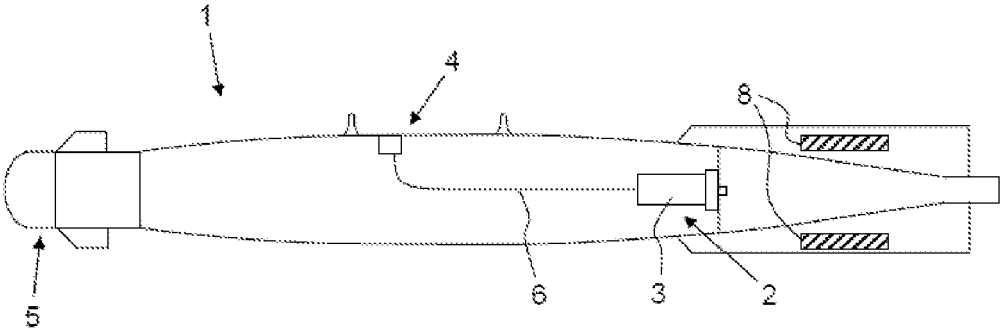
FIG. 3 schematically illustrates a bomb equipped with a proximity sensor, according to the prior art.
Figure 4:
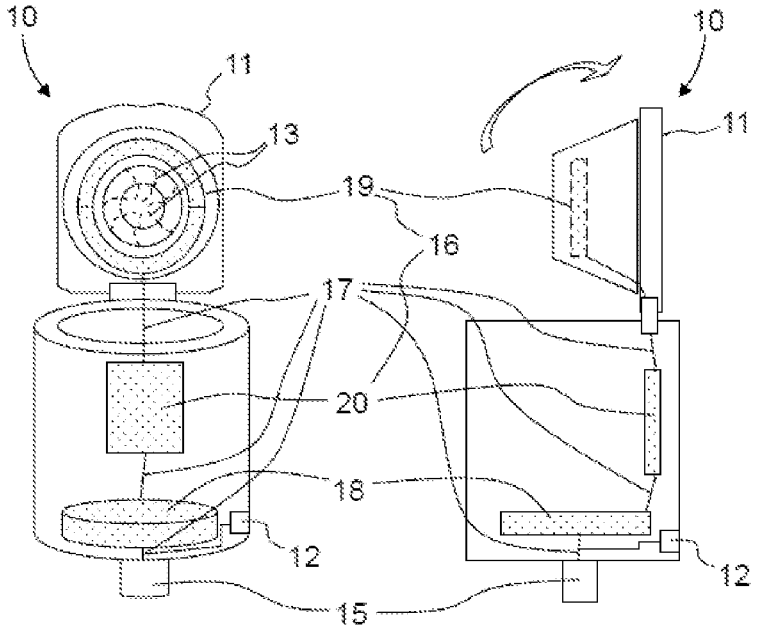
FIG. 4 schematically illustrates a bomb fuze initiator, according to one aspect of the invention.

FIG. 4 schematically shows a bomb fuze initiator 10 equipped with a cap 11 configured to open after release of the bomb, a device 12 for detecting bomb release, a device 13 for determining bomb speed, an integrated proximity sensor and a fuze connector 15 intended to connect the fuze initiator 10 to a bomb fuze, the integrated proximity sensor comprising:

a transceiver 16 of electromagnetic waves; and a transmission link 17 configured to transmit the signal delivered by the transceiver 16 of electromagnetic waves.

The integrated proximity sensor also comprises an electronic circuit 18 for processing the signal delivered by the transceiver 16 of electromagnetic waves, said circuit being configured to determine the distance between the bomb and the ground based on said signal, and to transmit said distance to the bomb fuze via the connector 15.

The transceiver 16 of electromagnetic waves may comprise an HF antenna 19 and an HF circuit 20.

The antenna-based transceiver 16 composed of an antenna 19 and electronic components 20 for generating and coupling microwaves may be installed at the front of the cone-shaped cap 11 of the device 13 for determining bomb speed, which sticks out from the body of the bomb once release has been achieved.

Operation of the microwave transceiver 16 (components 19, 20) is synchronized by the board 18 used to process the signal. The microwave transceiver 16 (components 19, 20) delivers a low-frequency signal to the board 18 used to process the signal.

The microwave transceiver 16 (components 19, 20) is connected to the board or electronic circuit 18 used to process the signal by a link 17, for example one formed using a flexible circuit board.

The electronic circuit 18 used to process the signal analyses the low-frequency signal to determine the distance of the bomb from the ground. When the target height is reached, i.e. when the height, or distance between the bomb and the ground is smaller than an initiation command threshold, the board or electronic circuit 18 used to process the signal sends a detonation order to the bomb fuze through the connector 15.

The connector 15 is used to connect, via a wired link, the devices for detecting release and determining release speed of the fuze initiator 10 to the bomb fuze. The connector 15 is also used to supply power to the integrated proximity sensor after an arming delay, to deliver the detonation command signal, and to set up a serial communication link between the fuze and the fuze initiator.

Figure 5:
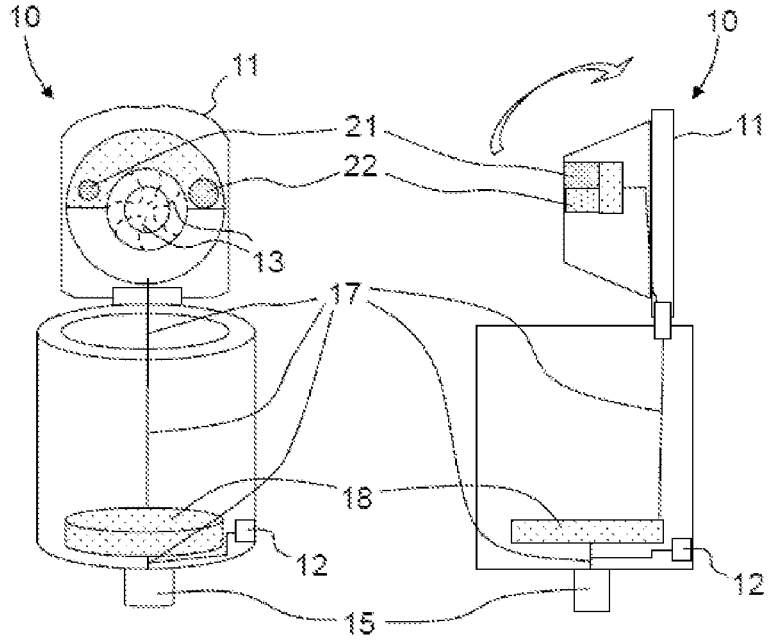
FIG. 5 schematically illustrates a bomb fuze initiator, according to another aspect of the invention, according to one aspect of the invention.

As a variant, as illustrated in FIG. 5, the transceiver 16 of electromagnetic waves may comprise an IR source 21 and a photodetector 22.

The device 12 for detecting bomb release in the active mode of the munition, which guarantees the cap is kept in closed position in the absence of a traction force consistent with active release, and which informs the bomb fuze on active munition release, may be formed by moving a magnet through an inductor, or by opening an electrical contact, or by a Hall-effect sensor.

The device 13 for determining bomb speed may be formed by an electrical generator impelled by air pressure (wind-energy conversion device) and deliver an AC voltage the frequency of which is directly related to release speed, or be formed by an air-pressure sensor, such as a pitot tube, or by a hot-wire anemometer.

The overall operation of the fuze system is as follows:

before release of the bomb, the fuze initiator 10 has its cap 11 closed;

on release, the cap 11 of the fuze initiator 10 opens via traction;

the device 12 for detecting bomb release generates a signal synonymous with opening of the cap 11 of the fuze initiator 10, which is delivered to the bomb fuze;

the device 13 for determining release speed delivers a signal relating to this speed to the fuze;

the fuze detects and analyses the signals delivered by the devices 12, 13 for detecting release and determining release speed;

if the signals are compliant, the bomb fuze counts down an arming delay of the bomb;

at the end of the arming delay, the bomb fuze turns on the proximity-sensing function of the fuze initiator 10;

the proximity sensor enters into an initializing phase, and the bomb fuze may exchange parameters with the proximity sensor;

at the end of this initializing phase, the proximity sensor enters into detection mode;

when the proximity sensor detects the initiation height, it generates a detonation signal intended for the bomb fuze;

the bomb fuze initiates the bomb.

Figure 6:
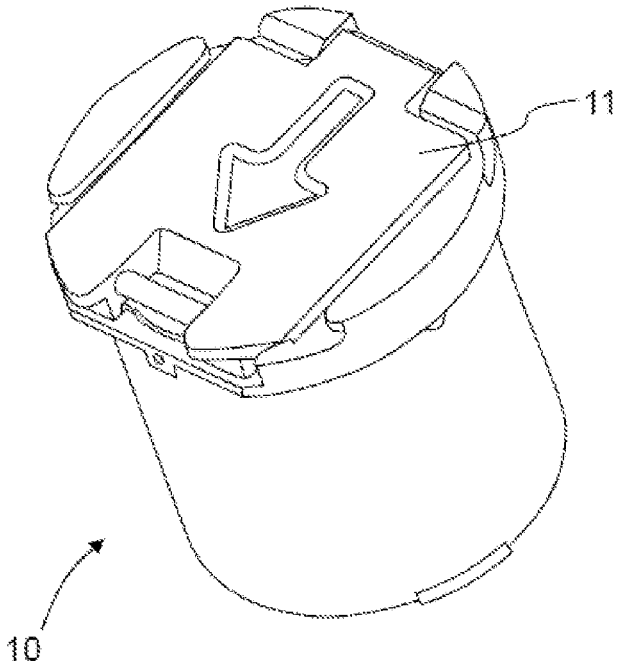
FIG. 6 schematically illustrates a bomb fuze initiator, according to one aspect of the invention.

FIG. 6 shows the fuze initiator 10, the cap 11 of which is closed before release, thus ensuring protection from outside elements.

Figure 7:
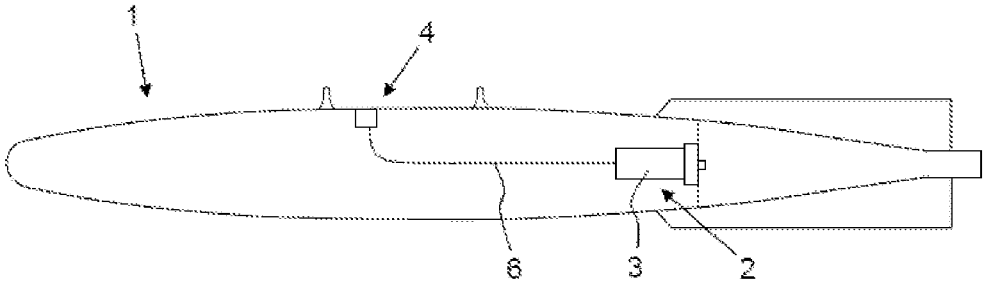
FIG. 7 schematically illustrates a bomb equipped with a bomb fuze initiator, according to one aspect of the invention.

FIG. 7 schematically shows a bomb 1 equipped with a bomb fuze 3 placed in a base well 2, and with a fuze initiator 10 placed in an accessory well 4, the connector 15 of the fuze initiator 10 being connected to the bomb fuze 3.

According to one aspect of the invention, the proximity-sensing function integrated into the fuze initiator 10 makes it possible to benefit from both a proximity-sensing function and use of a guidance kit without adding additional equipment.

Such a proximity sensor is not exposed to outside elements before release and does not require additional hardware to be installed.

According to one aspect of the invention, the fuze initiator 10 is compatible with a variant of installation with the fuze initiator located in the tail unit.

The present invention is applicable to the field of airborne bombs fastened under aeroplane pylons. It relates to a proximity-detecting device for a bomb fuze installed in a bomb base, which device does not require a separate external sensor to be added.

A given bomb fuze may be used with a fuze initiator with integrated proximity sensor according to the invention, or a standard fuze initiator.

The integrated proximity sensor may be programmable (target height and inhibition time).

Such a fuze initiator 10 with integrated proximity sensor is compatible with a variant of installation with the fuze initiator located in the tail unit.

Such a fuze initiator 10 with integrated proximity sensor is universal with respect to weapon configurations and not specific to one system.

Such a fuze initiator 10 with integrated proximity sensor does not require a separate system to initiate the proximity-sensing function.

Such a fuze initiator 10 with integrated proximity sensor advantageously decreases the cost of the solution consisting of the fuze system and proximity sensor, by avoiding duplication of structural components, cabling and power-supply-related components.

Furthermore, the proximity sensor is protected from the outside environment until release.

The invention claimed is:

1. A bomb fuze initiator equipped with a cone-shaped cap configured to open after bomb release, a device for detecting bomb release, a device for determining bomb speed, an integrated proximity sensor and a fuze connector intended to connect the fuze initiator to a bomb fuze, the integrated proximity sensor comprising:

a transceiver of electromagnetic waves comprising an HF antenna and an HF circuit, the HF antenna being installed at the front of the cone-shaped cap of the fuze initiator, the front of the cap protruding from the bomb body after release; and a transmission link configured to transmit the signal delivered by the transceiver of electromagnetic waves.

2. The bomb fuze initiator according to claim 1, comprising an electronic circuit for processing the signal delivered by the transceiver of electromagnetic waves, said circuit being configured to determine the distance between the bomb and the ground based on said signal, and to transmit said distance to the bomb fuze via the connector.

3. The bomb fuze initiator according to claim 1, wherein the release-detecting device is configured to detect release of the bomb and to guarantee the cap is kept in closed position in the absence of a traction force consistent with release, and configured to inform the bomb fuze of detection of release.

4. The bomb fuze initiator according to claim 1, wherein the device for determining release speed is configured to determine the release speed of the bomb and configured to inform the bomb fuze thereof.

5. A bomb equipped with a bomb fuze placed in a base well, comprising a bomb fuze initiator according to claim 1, placed in an accessory well, the connector of the fuze initiator being connected to the bomb fuze.

6. A bomb equipped with a bomb fuze placed in a base well, comprising a bomb fuze initiator according to claim 1, the bomb fuse initiator comprising an electronic circuit for processing the signal delivered by the transceiver of electromagnetic waves, said circuit being configured to determine the distance between the bomb and the ground based on said signal, and to transmit said distance to the bomb fuze via the connector, wherein the bomb fuze is configured to command detonation of the bomb when the distance between the bomb and the ground as determined by the electronic processing circuit is smaller than a detonation command threshold.

7. The bomb according to claim 6, wherein the threshold is comprised between 3 m and 16 m.

* * * * *